US006033520A

United States Patent [19]

Kimura et al.

[11] Patent Number: 6,033,520

[45] Date of Patent: Mar. 7, 2000

[54] APPARATUS FOR AND METHOD OF POLISHING WORKPIECE

[75] Inventors: Norio Kimura; Hozumi Yasuda, both of Fujisawa, Japan

[73] Assignee: Ebara Corporation, Tokyo, Japan

[21] Appl. No.: 08/728,070

[22] Filed: Oct. 9, 1996

[30] Foreign Application Priority Data

Oct. 9, 1995 [JP] Japan ..... 7-287976
Feb. 14, 1996 [JP] Japan ..... 8-050956

[51] Int. Cl.[7] ..... C23F 1/02; B24B 37/04

[52] U.S. Cl. ..... 156/345; 451/41; 451/285; 451/287; 451/288

[58] Field of Search ..... 156/345 LP

[56] References Cited

U.S. PATENT DOCUMENTS

| | | | |
|---|---|---|---|
| 4,954,142 | 9/1990 | Carr et al. | 51/309 |
| 5,205,082 | 4/1993 | Shendon et al. | 51/283 R |
| 5,584,751 | 12/1996 | Kobayashi et al. | 451/288 |
| 5,635,083 | 6/1997 | Breivogel et al. | 216/88 |
| 5,645,474 | 7/1997 | Kubo et al. | 451/287 |
| 5,651,724 | 7/1997 | Kimura et al. | 451/41 |
| 5,665,656 | 9/1997 | Jairath | 438/692 |
| 5,795,215 | 8/1998 | Guthrie et al. | 451/286 |

FOREIGN PATENT DOCUMENTS

| | | |
|---|---|---|
| 0 747 167 | 12/1996 | European Pat. Off. . |
| 50-133596 | 12/1975 | Japan . |
| 57-27659 | 2/1982 | Japan . |
| 2-503174 | 10/1990 | Japan . |

OTHER PUBLICATIONS

Patent Abstracts of Japan, vol. 005, No. 033 (M–057), Feb. 28, 1981 & JP–A–55 157473 (Nippon Telegr & Teleph Corp), Dec. 8, 1980, * abstract.*

Patent Abstracts of Japan, vol. 06, No. 089 (M–132), May 27, 1982 & JP–A–57 027659 (Supiide Fuamu KK), Feb. 15, 1982, *abstract.*

Patent Abstracts of Japan, vol. 012, No. 067 (M–673), Mar. 2, 1988 & JP–A–62 213960 (Hitachi Ltd), Sep. 19, 1987, *abstract.*

Patent Abstracts of Japan, vol. 013, No. 184 (E–751), Apr. 28, 1989 & JP–A–01 010642 (Sony Corp), Jan. 13, 1989, *abstract.*

*Primary Examiner*—Mukund J. Shah
*Assistant Examiner*—Deepak R. Rao
*Attorney, Agent, or Firm*—Wenderoth, Lind & Ponack, L.L.P.

[57] ABSTRACT

A polishing apparatus for polishing a workpiece such as a semiconductor wafer has a turntable with an abrasive cloth mounted on an upper surface thereof, and a top ring for holding a workpiece and pressing the workpiece against the abrasive cloth under a first pressing force to polish the workpiece. A guide ring is vertically movably disposed around the top ring, and pressed against the abrasive cloth under a variable second pressing force. The first and second pressing forces are variable independently of each other, and the second pressing force is determined based on the first pressing force.

12 Claims, 11 Drawing Sheets

$F_1 > F_2$ $F_1 \fallingdotseq F_2$ $F_1 < F_2$

POLISHING PRESSURE: 400gf/cm²
GUIDE RING SURFACE PRESSURE (gf/cm²)
600

POLISHING PRESSURE: 400gf/cm²
GUIDE RING SURFACE PRESSURE (gf/cm²)
500

POLISHING PRESSURE: 400gf/cm²
GUIDE RING SURFACE PRESSURE (gf/cm²)
400
THICKNESS OF REMOVED MATERIAL (Å)
6000
5000
4000
3000
2000
1000
0
100
95
90
85
80
DISTANCE FROM WAFER CENTER (mm)

POLISHING PRESSURE: 400gf/cm²

GUIDE RING SURFACE PRESSURE (gf/cm²)

300

POLISHING PRESSURE: 400gf/cm²

GUIDE RING SURFACE PRESSURE (gf/cm²)

200

APPARATUS FOR AND METHOD OF POLISHING WORKPIECE

BACKGROUND OF THE INVENTION

1. Field of the Invention

The present invention relates to an apparatus for and a method of polishing a workpiece such as a semiconductor wafer to a flat mirror finish, and more particularly to an apparatus for and a method of polishing a workpiece such as a semiconductor wafer which can control the amount of a material removed from a peripheral portion of the workpiece by a polishing action.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished to a flat mirror finish while the top ring and the turntable are rotating.

Attempts have heretofore been made to apply an elastic pad of polyurethane or the like to a workpiece holding surface of the top ring for uniformizing a pressing force applied from the top ring to the semiconductor wafer. If the pressing force applied from the top ring to the semiconductor wafer is uniformized, the semiconductor wafer is prevented from being excessively polished in a local area, and hence is planarized to a highly flat finish.

FIG. 9 of the accompanying drawings shows a conventional polishing apparatus. As shown in FIG. 9, the conventional polishing apparatus comprises a turntable 41 with an abrasive cloth 42 attached to an upper surface thereof, a top ring 45 for holding a semiconductor wafer 43 to press the semiconductor wafer 43 against the abrasive cloth 42, and an abrasive liquid supply nozzle 48 for supplying an abrasive liquid Q to the abrasive cloth 42. The top ring 45 is connected to a top ring shaft 49, and is provided with an elastic pad 47 of polyurethane or the like on its lower surface. The semiconductor wafer 43 is held by the top ring 45 in contact with the elastic pad 47. The top ring 45 also has a cylindrical retainer ring 46 on an outer circumferential edge thereof for retaining the semiconductor wafer 43 on the lower surface of the top ring 45. Specifically, the retainer ring 46 is fixed to the top ring 45, and has a lower end projecting downwardly from the lower surface of the top ring 45 for holding the semiconductor wafer 43 on the elastic pad 47 to prevent removal of the top ring 45 under frictional engagement with the abrasive cloth 42 during a polishing process.

In operation, the semiconductor wafer 43 is held against the lower surface of the elastic pad 47 which is attached to the lower surface of the top ring 45. The semiconductor wafer 43 is then pressed against the abrasive cloth 42 on the turntable 41 by the top ring 45, and the turntable 41 and the top ring 45 are rotated independently of each other to move the abrasive cloth 42 and the semiconductor wafer 43 relatively to each other, thereby polishing the semiconductor wafer 43. The abrasive liquid Q comprises an alkaline solution containing an abrasive grain of fine particles suspended therein, for example. The semiconductor wafer 43 is polished by a composite action comprising a chemical polishing action of the alkaline solution and a mechanical polishing action of the abrasive grain.

FIG. 10 of the accompanying drawings shows in a fragmental cross-section the semiconductor wafer 43, the abrasive cloth 42, and the elastic pad 47. As shown in FIG. 10, the semiconductor wafer 43 has a peripheral portion which is a boundary between contact and noncontact with the abrasive cloth 42 and also is a boundary between contact and noncontact with the elastic pad 47. At the peripheral portion of the semiconductor wafer 43, the polishing pressure applied to the semiconductor wafer 43 by the abrasive cloth 42 and the elastic pad 47 is not uniform, thus the peripheral portion of the semiconductor wafer 43 is liable to be polished to an excessive degree. As a result, the peripheral edge of the semiconductor wafer 43 is often polished to have rounded edges.

FIG. 11 of the accompanying drawings illustrates the relationship between radial positions and polishing pressures calculated by the finite element method, and the relationship between radial positions and thicknesses of a surface layer, with respect to a 6-inch semiconductor wafer having a silicon oxide layer ($SiO_2$) deposited thereon. In FIG. 11, blank dots represent calculated values of the polishing pressure (gf/cm$^2$) as determined by the finite element method, and solid dots represent measured values of the thickness of the surface layer (Å) after the semiconductor wafer was polished. The calculated values of the polishing pressure are irregular at a peripheral portion ranging from 70 mm to 74 mm on the semiconductor wafer, and the measured values of the thickness of the surface layer are correspondingly irregular at a peripheral portion ranging from 70 mm to 73.5 mm on the semiconductor wafer. As can be seen from the measured values of the thickness of the surface layer, the peripheral portion of the semiconductor wafer is excessively polished.

In order to prevent the peripheral portion of the semiconductor wafer from being excessively polished, there has been proposed a polishing apparatus having a retainer ring comprising a weight which is vertically movable with respect to a top ring as disclosed in Japanese laid-open patent publication No. 55-157473. In this polishing apparatus, the retainer ring is provided around the top ring and pressed against an abrasive cloth due to gravity.

The top ring of the above proposed polishing apparatus is capable of varying the pressing force for pressing the semiconductor wafer against the abrasive cloth depending on the type of the semiconductor wafer and the polishing conditions. However, since the retainer ring cannot vary its pressing force applied against the abrasive cloth, the pressing force applied by the retainer ring may be too large or too small compared to the adjusted pressing force imposed by the top ring. As a consequence, the peripheral portion of the semiconductor wafer may be polished excessively or insufficiently.

According to another proposed polishing apparatus disclosed in Japanese patent publication No. 58-10193, a spring is interposed between a top ring and a retainer ring for resiliently pressing the retainer ring against an abrasive cloth.

The spring-loaded retainer ring exerts a pressing force which is not adjustable because the pressing force is dependent on the spring that is used. Therefore, whereas the top ring can vary its pressing force for pressing the semiconductor wafer against the abrasive cloth depending on the type of the semiconductor wafer and the polishing conditions, the pressing force applied to the abrasive cloth by the retainer ring cannot be adjusted. Consequently, the pressing force applied by the retainer ring may be too large or too small compared to the adjusted pressing force imposed by the top ring. The peripheral portion of the semiconductor wafer may thus be polished excessively or insufficiently.

SUMMARY OF THE INVENTION

It is therefore an object of the present invention to provide an apparatus for and a method of polishing a workpiece, with a guide ring disposed around a top ring for applying an optimum pressing force to an abrasive cloth depending on the type of a workpiece and the polishing conditions to thereby prevent a peripheral portion of the workpiece from being polished excessively or insufficiently for thereby polishing the workpiece to a highly planarized finish.

Another object of the present invention is to provide an apparatus for and a method of polishing a workpiece while controlling the amount of a material removed from a peripheral portion of the workpiece by a polishing action in order to meet demands for the removal of a greater or smaller thickness of material from the peripheral portion of the workpiece than from an inner region of the workpiece depending on the type of the workpiece.

According to an aspect of the present invention, there is provided an apparatus for polishing a workpiece, comprising: a turntable with an abrasive cloth mounted on an upper surface thereof; a top ring for holding a workpiece and pressing the workpiece against the abrasive cloth under a first pressing force to polish the workpiece; a guide ring for retaining said workpiece under the top ring, the guide ring being vertically movably disposed around the top ring; and a pressing device for pressing the guide ring against the abrasive cloth under a second pressing force which is variable.

According to another aspect of the present invention, there is provided a method of polishing a workpiece, comprising: holding a workpiece between an abrasive cloth mounted on an upper surface of a turntable and a lower surface of a top ring disposed above said turntable; pressing the workpiece against the abrasive cloth under a first pressing force to polish the workpiece; and pressing a guide ring vertically movably disposed around the top ring against the abrasive cloth around the workpiece under a second pressing force which is determined based on the first pressing force, the guide ring retaining the workpiece under the top ring.

According to still another aspect of the present invention, there is provided a method of fabricating a semiconductor device comprising holding a semiconductor wafer between an abrasive cloth mounted on an upper surface of a turntable and a lower surface of a top ring disposed above the turntable; pressing the semiconductor wafer against the abrasive cloth under a first pressing force to polish the semiconductor wafer; and pressing a guide ring vertically movably disposed around the top ring against the abrasive cloth around the workpiece under a second pressing force which is determined based on the first pressing force, said guide ring retaining the workpiece under the top ring.

According to the present invention, the distribution of the pressing force of the workpiece can be prevented from being nonuniform at the peripheral portion of the workpiece during the polishing process, and the polishing pressures can be uniformized over the entire surface of the workpiece. Therefore, the peripheral portion of the semiconductor wafer is prevented from being polished excessively or insufficiently. The entire surface of workpiece can thus be polished to a flat mirror finish. In the case where the present invention is applied to semiconductor manufacturing processes, the semiconductor devices can be polished to a high quality. Since the peripheral portion of the semiconductor wafer can be used as products, yields of the semiconductor devices can be increased.

In the case where there are demands for the removal of a greater or smaller thickness of material from the peripheral portion of the semiconductor wafer than from the inner region of the semiconductor wafer depending on the type of the semiconductor wafer, the amount of the material removed from the peripheral portion of the semiconductor wafer can be intentionally increased or decreased.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
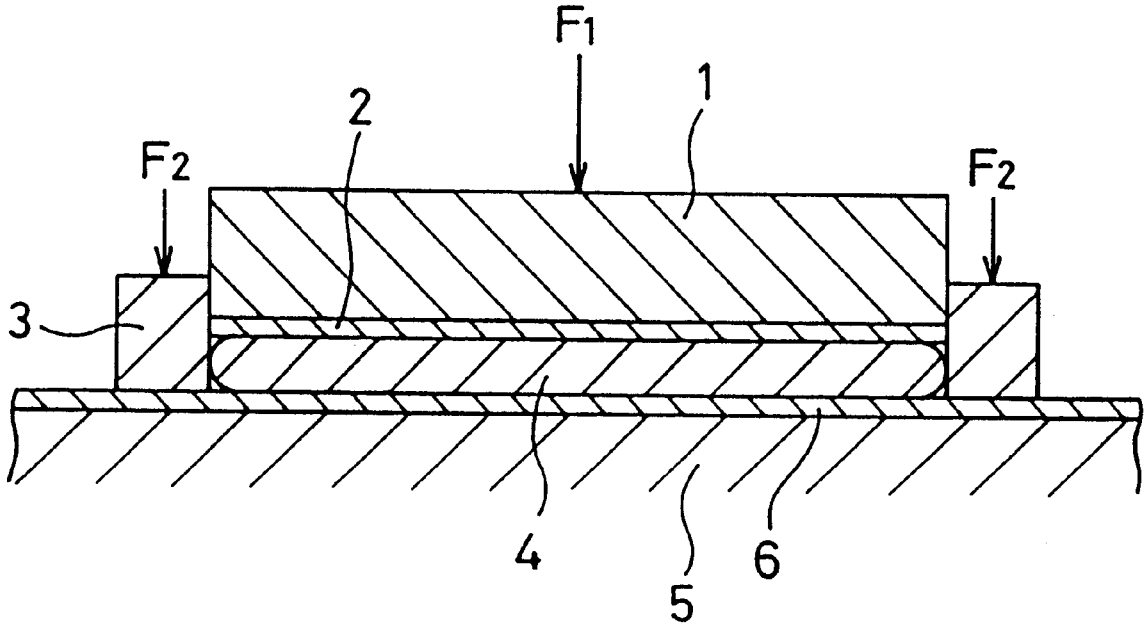
FIG. 1 is a fragmentary vertical cross-sectional view showing the basic principles of the present invention.

Like or corresponding parts are denoted by like or corresponding reference numerals throughout views.

FIG. 1 shows the basic principles of the present invention. As shown in FIG. 1, the polishing apparatus has a top ring 1 and an elastic pad 2 of polyurethane or the like attached to the lower surface of the top ring 1. A guide ring 3 is disposed around the top ring 1 and is vertically movable with respect to the top ring 1. A semiconductor wafer 4 which is a workpiece to be polished is accommodated in a space defined by the lower surface of the top ring 1 and the inner circumferential surface of the guide ring 3.

The top ring 1 applies a pressing force $F_1$ (pressure per unit area, gf/cm$^2$) to press the semiconductor wafer 4 against an abrasive cloth 6 on a turntable 5, and the guide ring 3 applies a pressing force $F_2$ (pressure per unit area, gf/cm$^2$) to press the abrasive cloth 6. These pressing forces $F_1$, $F_2$ are variable independently of each other. Therefore, the pressing force $F_2$ which is applied to the abrasive cloth 6 by the guide ring 3 can be changed depending on the pressing force $F_1$ which is applied by the top ring 1 to press the semiconductor wafer 4 against the abrasive cloth 6.

Theoretically, if the pressing force $F_1$ which is applied by the top ring 1 to press the semiconductor wafer 4 against the abrasive cloth 6 is equal to the pressing force $F_2$ which is applied to the abrasive cloth 6 by the guide ring 3, then the distribution of applied polishing pressures, which result from a combination of the pressing forces $F_1$, $F_2$, is continuous and uniform from the center of the semiconductor wafer 4 to its peripheral edge and further to an outer circumferential edge of the guide ring 3 disposed around the semiconductor wafer 4. Accordingly, the peripheral portion of the semiconductor wafer 4 is prevented from being polished excessively or insufficiently.

Figure 2A:
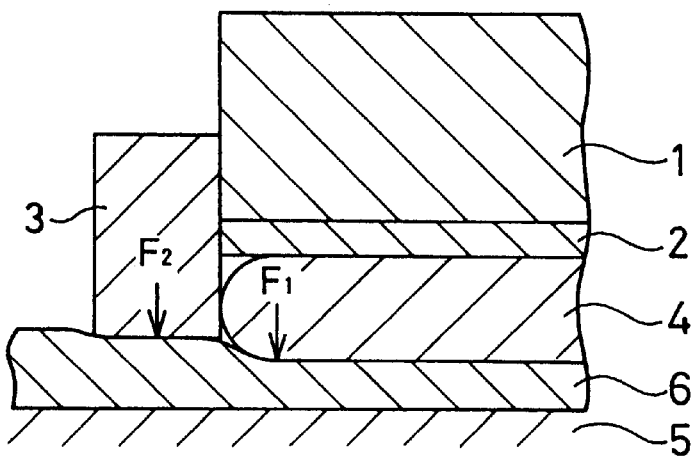
FIGS. 2A, 2B, and 2C are enlarged fragmentary vertical cross-sectional views showing the behavior of an abrasive cloth when the relationship between a pressing force applied by a top ring and a pressing force applied by a guide ring is varied.
Figure 2B:
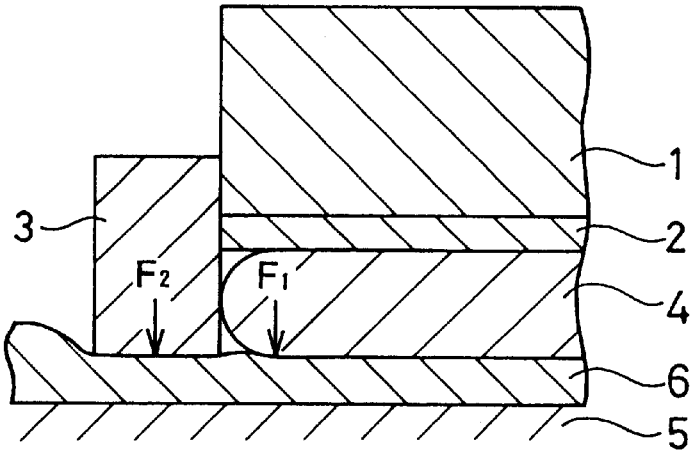
Figure 2C:
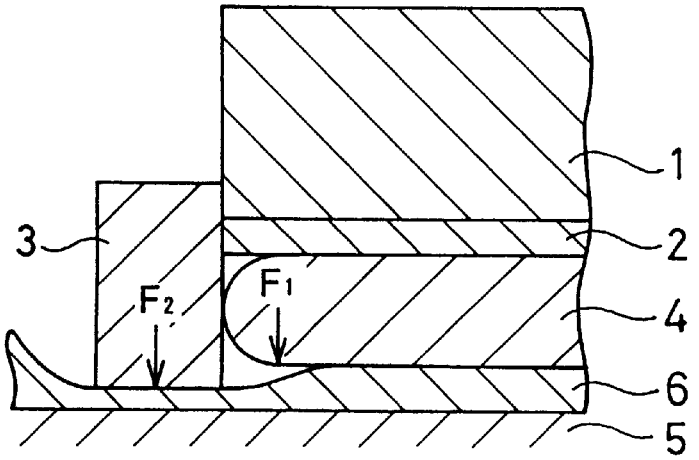

FIGS. 2A through 2C schematically show how the abrasive cloth 6 behaves when the relationship between the pressing force $F_1$ and the pressing force $F_2$ is varied. In FIG. 2A, the pressing force $F_1$ is greater than the pressing force $F_2$ ($F_1>F_2$). In FIG. 2B, the pressing force $F_1$ is nearly equal to the pressing force $F_2$ ($F_1\approx F_2$) In FIG. 2C, the pressing force $F_1$ is smaller than the pressing force $F_2$ ($F_1<F_2$).

As shown in FIGS. 2A through 2C, when the pressing force $F_2$ applied to the abrasive cloth 6 by the guide ring 3 is progressively increased, the abrasive cloth 6 pressed by the guide ring 3 is progressively compressed, thus progressively changing its state of contact with the peripheral portion of the semiconductor wafer 4, i.e., progressively reducing its area of contact with the peripheral portion of the semiconductor wafer 4. Therefore, when the relationship between the pressing force $F_1$ and the pressing force $F_2$ is changed in various patterns, the distribution of polishing pressures on the semiconductor wafer 4 over its peripheral portion and inner region is also changed in various patterns.

As shown in FIG. 2A, when the pressing force $F_1$ is greater than the pressing force $F_2$ ($F_1>F_2$), the polishing pressure applied to the peripheral portion of the semiconductor wafer 4 is greater than the polishing pressure applied to the inner region of the semiconductor wafer 4, so that the amount of a material removed from the peripheral portion of the semiconductor wafer 4 is greater than the amount of a material removed from the inner region of the semiconductor wafer 4 while the semiconductor wafer 4 is being polished.

As shown in FIG. 2B, when the pressing force $F_1$ is substantially equal to the pressing force $F_2$ ($F_1\approx F_2$), the distribution of polishing pressures is continuous and uniform from the center of the semiconductor wafer 4 to its peripheral edge and further to the outer circumferential edge of the guide ring 3, so that the amount of a material removed from the semiconductor wafer 4 is uniform from the peripheral edge to the inner region of the semiconductor wafer 4 while the semiconductor wafer 4 is being polished.

As shown in FIG. 2C, when the pressing force $F_1$ is smaller than the pressing force $F_2$ ($F_1<F_2$), the polishing pressure applied to the peripheral portion of the semiconductor wafer 4 is smaller than the polishing pressure applied to the inner region of the semiconductor wafer 4, so that the amount of a material removed from the peripheral edge of the semiconductor wafer 4 is smaller than the amount of a material removed from the inner region of the semiconductor wafer 4 while the semiconductor wafer 4 is being polished.

The pressing force $F_1$ and the pressing force $F_2$ can be changed independently of each other before polishing or during polishing.

FIGS. 3A through 3E show the results of an experiment in which a semiconductor wafer was polished based on the basic principles of the present invention. The semiconductor wafer used in the experiment was an 8-inch semiconductor wafer. In the experiment, the pressing force (polishing pressure) applied to the semiconductor wafer by the top ring was a constant level of 400 gf/cm$^2$, and the pressing force applied by the guide ring was changed from 600 to 200 gf/cm$^2$ successively by decrements of 100 gf/cm$^2$. Specifically, the pressing force applied by the guide ring was 600 gf/cm$^2$ in FIG. 3A, 500 gf/cm$^2$ in FIG. 3B, 400 gf/cm$^2$ in FIG. 3C, 300 gf/cm$^2$ in FIG. 3D, and 200 gf/cm$^2$ in FIG. 3E. In each of FIGS. 3A through 3E, the horizontal axis represents a distance (mm) from the center of the semiconductor wafer, and the vertical axis represents a thickness (A) of a material removed from the semiconductor wafer.

Figures 3A, 3B, 3C:
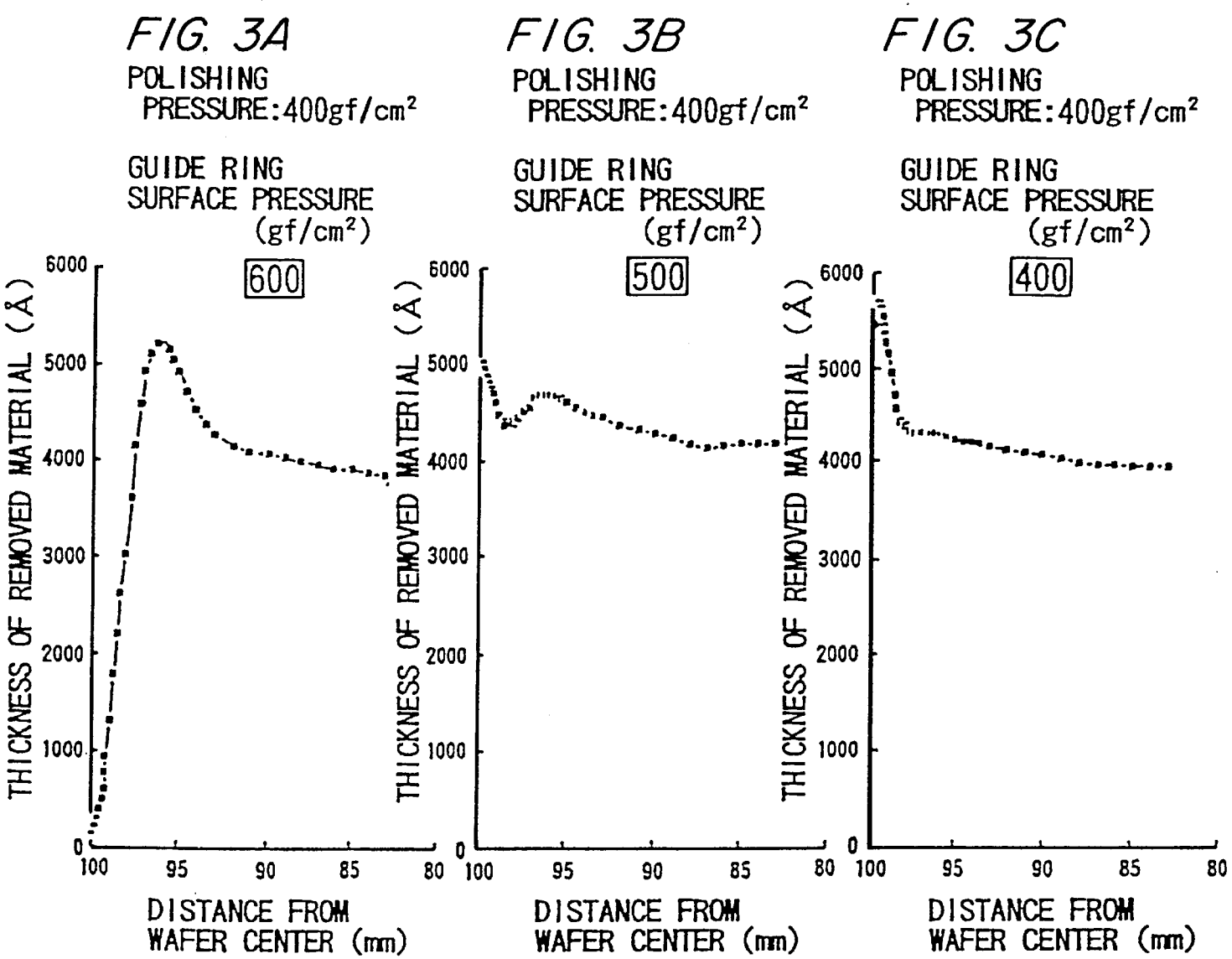
FIGS. 3A through 3E are graphs showing the results of an experiment in which a semiconductor wafer was polished based on the basic principles of the present invention.
Figure 3D:
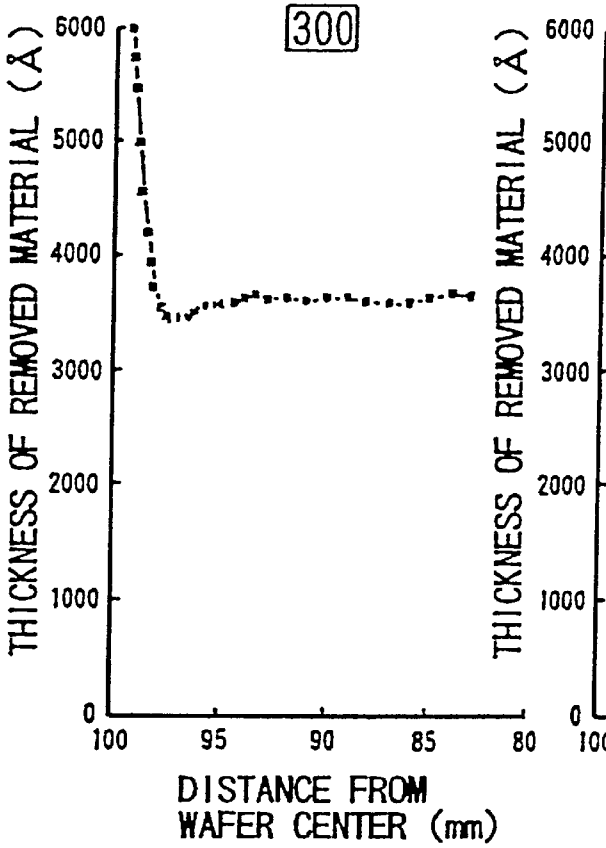
Figure 3E:
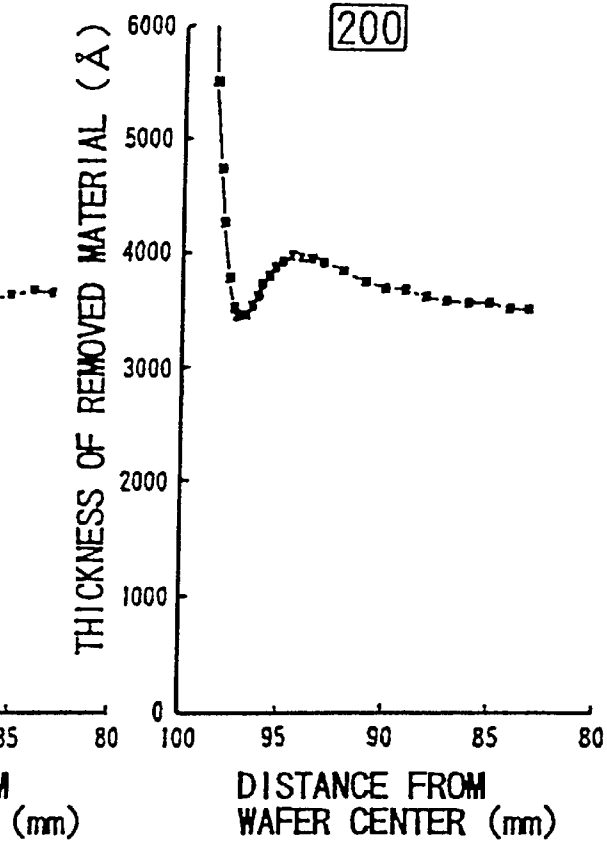

As shown in FIGS. 3A through 3E, the thickness of the removed material at the radial positions on the semiconductor wafer is affected when the pressing force applied by the guide ring was changed. Specifically, when the pressing force applied by the guide ring was in the range from 200 to 300 gf/cm$^2$, as shown in FIGS. 3D and 3E, the peripheral portion of the semiconductor wafer was excessively polished. When the pressing force applied by the guide ring was in the range from 400 to 500 gf/cm$^2$, as shown in FIGS. 3B and 3C, the peripheral portion of the semiconductor wafer is substantially equally polished from the peripheral edge to the inner region of the semiconductor wafer. When the pressing force applied by the guide ring was 600 gf/cm$^2$, as shown in FIG. 3A, the peripheral portion of the semiconductor wafer was polished insufficiently.

The experimental results shown in FIGS. 3A through 3E indicate that the amount of the material removed from the peripheral portion of the semiconductor wafer can be adjusted by varying the pressing force applied by the guide ring independently of the pressing force applied by the top ring. From a theoretical standpoint, the peripheral portion of the semiconductor wafer should be polished optimally when the pressing force applied by the guide ring is equal to the pressing force applied by the top ring. However, since the polishing action depends on the type of the semiconductor wafer and the polishing conditions, the pressing force applied by the guide ring is selected to be of an optimum value based on the pressing force applied by the top ring depending on the type of the semiconductor wafer and the polishing conditions.

There are demands for the removal of a greater or smaller thickness of material from the peripheral portion of the semiconductor wafer than from the inner region of the semiconductor wafer depending on the type of the semiconductor wafer. To meet such demands, the pressing force applied by the guide ring is selected to be of an optimum value based on the pressing force applied by the top ring to intentionally increase or reduce the amount of the material removed from peripheral portion of the semiconductor wafer.

Figure 4:
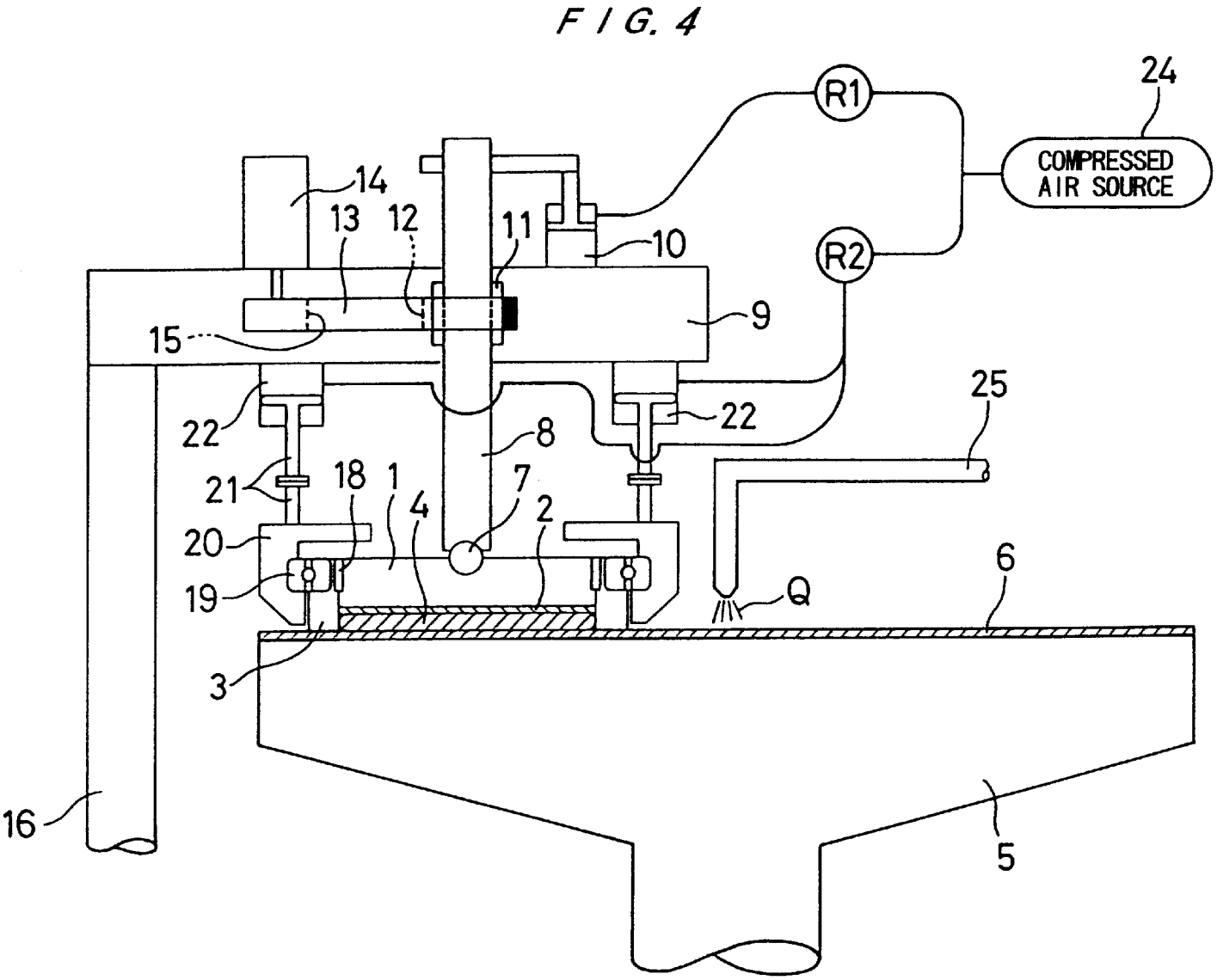
FIG. 4 is a vertical cross-sectional view of a polishing apparatus according to a first embodiment of the present invention.
Figure 5:
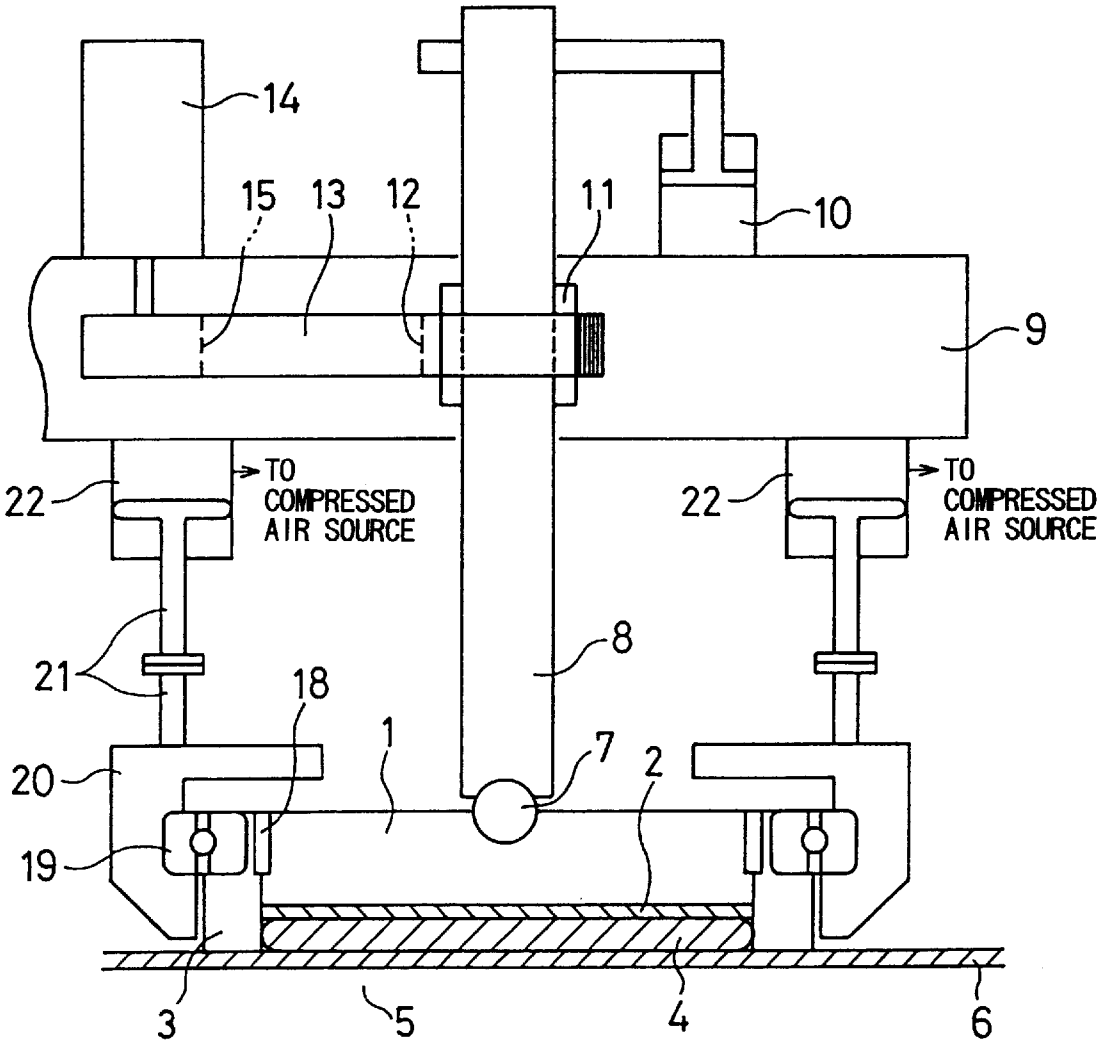
FIG. 5 is an enlarged fragmentary vertical cross-sectional view of the polishing apparatus according to the first embodiment.

FIGS. 4 and 5 show a polishing apparatus according to a first embodiment of the present invention.

As shown in FIGS. 4 and 5, a top ring 1 has a lower surface for supporting a semiconductor wafer 4 thereon which is a workpiece to be polished. An elastic pad 2 of polyurethane or the like is attached to the lower surface of the top ring 1. A guide ring 3 is disposed around the top ring 1 and vertically movable with respect to the top ring 1. A turntable 5 with an abrasive cloth 6 attached to an upper surface thereof is disposed below the top ring 1.

The top ring 1 is connected to a vertical top ring shaft 8 whose lower end is held against a ball 7 mounted on an upper surface of the top ring 1. The top ring shaft 8 is operatively coupled to a top ring air cylinder 10 fixedly mounted on an upper surface of a top ring head 9. The top ring shaft 8 is vertically movable by the top ring air cylinder 10 to press the semiconductor wafer 4 supported on the elastic pad 2 against the abrasive cloth 6 on the turntable 5.

The top ring shaft 8 has an intermediate portion extending through and corotatably coupled to a rotatable cylinder 11 by a key (not shown), and the rotatable cylinder 11 has a pulley 12 mounted on outer circumferential surface thereof. The pulley 12 is operatively connected by a timing belt 13 to a timing pulley 15 mounted on the rotatable shaft of a top ring motor 14 which is fixedly mounted on the top ring head 9. Therefore, when the top ring motor 14 is energized, the rotatable cylinder 11 and the top ring shaft 8 are integrally rotated through the timing pulley 15, the timing belt 13 and the timing pulley 12. Thus the top ring 1 is rotated. The top ring head 9 is supported by a top ring head shaft 16 which is vertically fixed on a frame (not shown).

The guide ring 3 is corotatably, but vertically movably, coupled to the top ring 1 by a key 18. The guide ring 3 is rotatably supported by a bearing 19 which is mounted on a bearing holder 20. The bearing holder 20 is connected by vertical shafts 21 to a plurality of (three in this embodiment) circumferentially spaced guide ring air cylinders 22. The guide ring air cylinders 22 are secured to a lower surface of the top ring head 9.

The top ring air cylinder 10 and the guide ring air cylinders 22 are pneumatically connected to a compressed air source 24 through regulators R1, R2, respectively. The regulator R1 regulates an air pressure supplied from the compressed air source 24 to the top ring air cylinder 10 to adjust the pressing force which is applied by the top ring 1 to press the semiconductor wafer 4 against the abrasive cloth 6. The regulator R2 also regulates the air pressure supplied from the compressed air source 24 to the guide ring air cylinder 22 to adjust the pressing force which is applied by the guide ring 3 to press the abrasive cloth 6. The regulators R1 and R2 are controlled by a controller (not shown in FIG. 4).

An abrasive liquid supply nozzle 25 is positioned above the turntable 5 for supplying an abrasive liquid Q onto the abrasive cloth 6 on the turntable 5.

The polishing apparatus shown in FIGS. 4 and 5 operates as follows: The semiconductor wafer 4 to be polished is held under the top ring against the elastic pad 2, and the top ring air cylinder 10 is actuated to lower the top ring 1 toward the turntable 5 until the semiconductor wafer 4 is pressed against the abrasive cloth 6 on the upper surface of the rotating turntable 5. The top ring 1 and the guide ring 3 are rotated by the top ring motor 14 through the top ring shaft 8. Since the abrasive liquid Q is supplied onto the abrasive cloth 6 by the abrasive liquid supply nozzle 25, the abrasive liquid Q is retained on the abrasive cloth 6. Therefore, the lower surface of the semiconductor wafer 4 is polished with the abrasive liquid Q which is present between the lower surface of the semiconductor wafer 4 and the abrasive cloth 6.

Depending on the pressing force applied by the top ring 1 actuated by the top ring air cylinder 10, the pressing force applied to the abrasive cloth 6 by the guide ring 3 actuated by the guide ring air cylinders 22 is adjusted while the semiconductor wafer 4 is being polished. During the polishing process, the pressing force $F_1$ (see FIG. 1) which is applied by the top ring 1 to press the semiconductor wafer 4 against the abrasive cloth 6 can be adjusted by the regulator R1, and the pressing force $F_2$ which is applied by the guide ring 3 to press the abrasive cloth 6 can be adjusted by the regulator R2. Therefore, during the polishing process, the pressing force $F_1$ applied by the guide ring 3 to press the abrasive cloth 6 can be changed depending on the pressing force $F_1$ applied by the top ring 1 to press the semiconductor wafer 4 against the abrasive cloth 6. By adjusting the pressing force $F_2$ with respect to the pressing force $F_1$, the distribution of polishing pressures is made continuous and uniform from the center of the semiconductor wafer 4 to its peripheral edge and further to the outer circumferential edge of the guide ring 3 disposed around the semiconductor wafer 4. Consequently, the peripheral portion of the semiconductor wafer 4 is prevented from being polished excessively or insufficiently. The semiconductor wafer 4 can thus be polished to a high quality and with a high yield.

If a greater or smaller thickness of material is to be removed from the peripheral portion of the semiconductor wafer 4 than from the inner region of the semiconductor wafer 4, then the pressing force $F_2$ applied by the guide ring 3 is selected to be of a suitable value based on the pressing force $F_1$ applied by the top ring 1 to intentionally increase or reduce the amount of a material removed from the peripheral portion of the semiconductor wafer 4.

Figure 6:
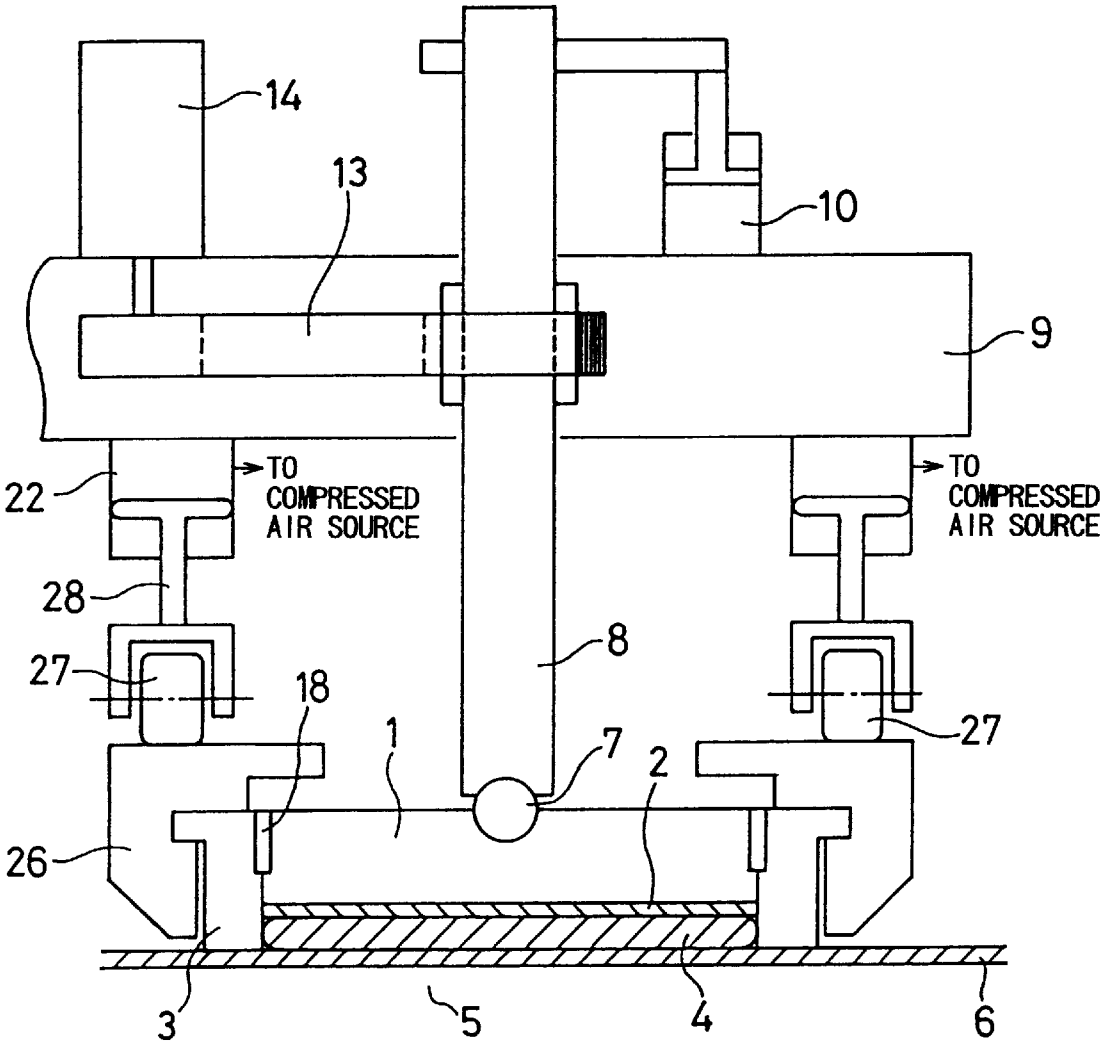
FIG. 6 is an enlarged fragmentary vertical cross-sectional view of the polishing apparatus according to a second embodiment.

FIG. 6 shows a polishing apparatus according to a second embodiment of the present invention.

As shown in FIG. 6, the guide ring 3 disposed around the top ring 1 is held by a guide ring holder 26 which can be pressed downwardly by a plurality of rollers 27. The rollers 27 are rotatably supported by respective shafts 28 which are connected to the respective guide ring air cylinders 22 fixed to the lower surface of the top ring head 9. The guide ring 3 is vertically movable with respect to the top ring 1, and rotatable in unison with the top ring 1, as with the first embodiment shown in FIGS. 4 and 5.

In operation, while the top ring 1 and the guide ring 3 are rotated, the rollers 27 are rotated about their own axis while the rollers 27 are in rolling contact with the guide ring holder 26. At this time, the guide ring 3 is pressed downwardly by the rollers 27, which are lowered by the guide ring air cylinders 22, thereby pressing the abrasive cloth 6.

Other structural and functional details of the polishing apparatus according to the second embodiment are identical to those of the polishing apparatus according to the first embodiment.

In the first and second embodiments, the pressing force is transmitted from the guide ring air cylinders 22 to the guide ring 3 through the shafts 21, 28 which are independently positioned around the top ring shaft 8 and are not rotated integrally with the top ring shaft 8. Consequently, it is possible to vary the pressing force applied to the guide ring 3 during the polishing process, i.e., while the semiconductor wafer 4 is being polished.

Figure 7:
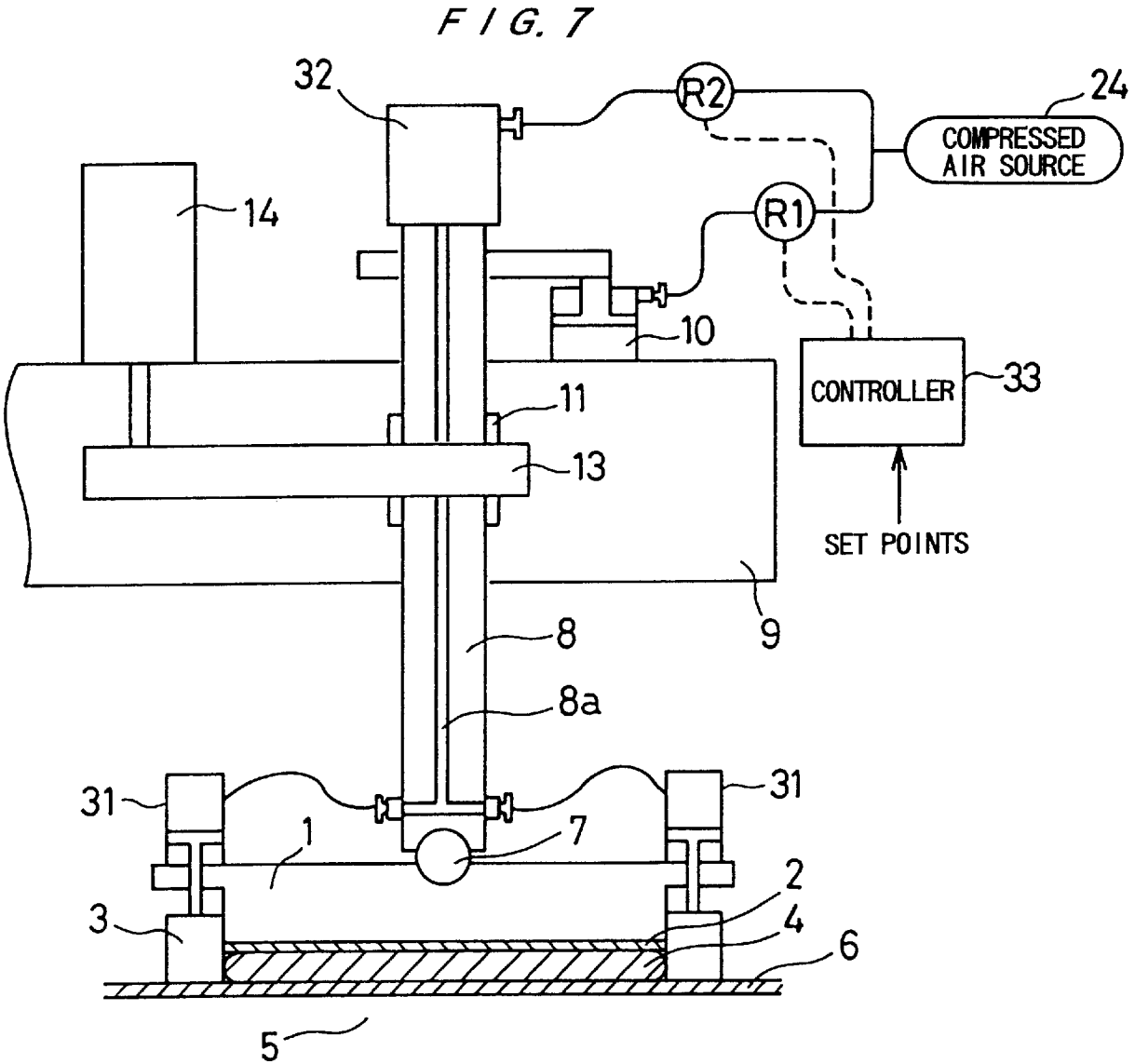
FIG. 7 is an enlarged fragmentary vertical cross-sectional view of the polishing apparatus according to a third embodiment.

FIG. 7 shows a polishing apparatus according to a third embodiment of the present invention.

As shown in FIG. 7, the guide ring 3 disposed around the top ring 1 is connected to a plurality of guide ring air cylinders 31 fixedly mounted on the top ring 1. The guide ring air cylinders 31 are pneumatically connected to the compressed air source 24 through a communication passage 8*a* defined axially in the top ring shaft 8, a rotary joint 32 mounted on the upper end of the top ring shaft 8, and the regulator R2.

The top ring air cylinder 10 is pneumatically connected to the compressed air source 24 through the regulator R1. The regulators R1, R2 are electrically connected to a controller 33.

The polishing apparatus according to the third embodiment operates as follows: The semiconductor wafer 4 is polished by being pressed against the abrasive cloth 6 under the pressing force applied by the top ring 1 which is actuated by the top ring air cylinder 10. The guide ring 3 is pressed against the abrasive cloth 6 by the guide ring air cylinders 31. When the guide ring 3 is pressed against the abrasive cloth 6, the guide ring 3 is subjected to reactive forces which affect the pressing force applied by the top ring 1. To avoid such a problem, according to the third embodiment, set-points for the pressing forces to be applied by the top ring 1 and the guide ring 3 are inputted to the controller 33, which calculates air pressures to be delivered to the top ring air cylinder 10 and the guide ring air cylinders 31. The controller 33 then controls the regulators R1, R2 to supply the calculated air pressures to the top ring air cylinder 10 and the guide ring air cylinders 31, respectively. Therefore, the top ring 1 and the guide ring 3 can apply desired pressing forces to the semiconductor wafer 4 and the abrasive cloth 6, respectively. The pressing forces applied by the top ring 1 and the guide ring 3 can thus be changed independently of each other while the semiconductor wafer 4 is being polished.

Other structural and functional details of the polishing apparatus according to the third embodiment are identical to those of the polishing apparatus according to the first embodiment.

In the third embodiment, the compressed air is supplied from the compressed air source 24 through the rotary joint 32 to the guide ring air cylinders 31. As a consequence, the pressing force applied by the guide ring 3 can be changed during the polishing process, i.e., while the semiconductor wafer 4 is being polished.

Figure 8A:
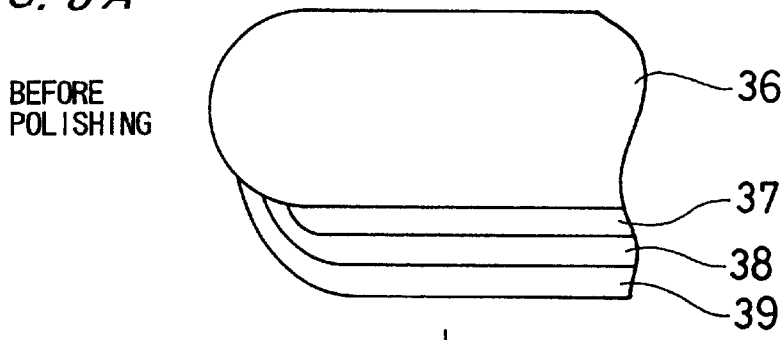
FIGS. 8A through 8D are enlarged fragmentary vertical cross-sectional views showing an example in which the amount of a material removed from a peripheral edge of a workpiece is smaller than the amount of a material removed from an inner region of the workpiece.
Figure 8B:
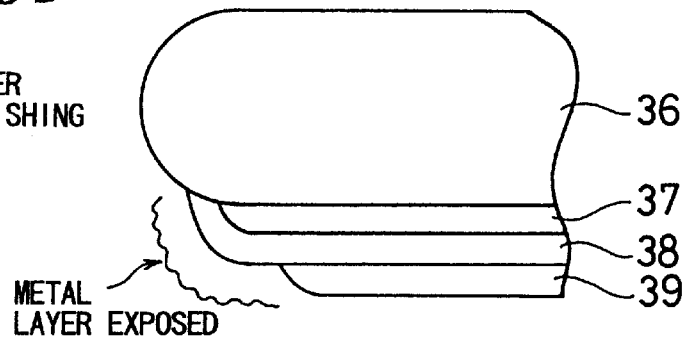
Figure 8C:
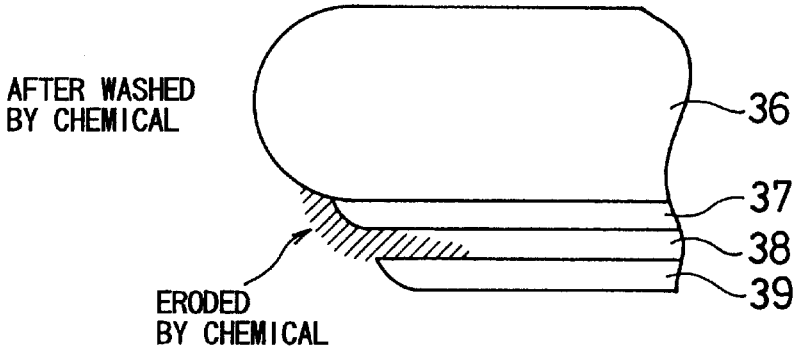
Figure 8D:
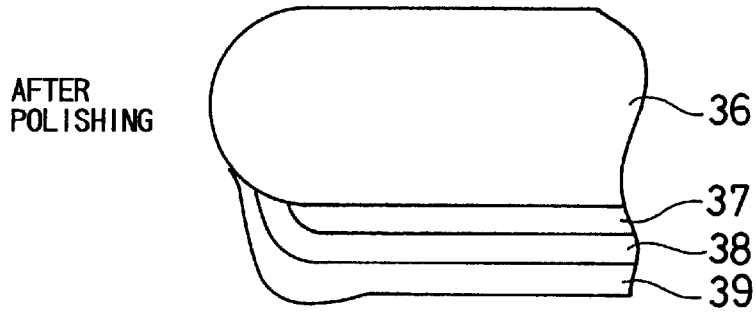
Figure 9:
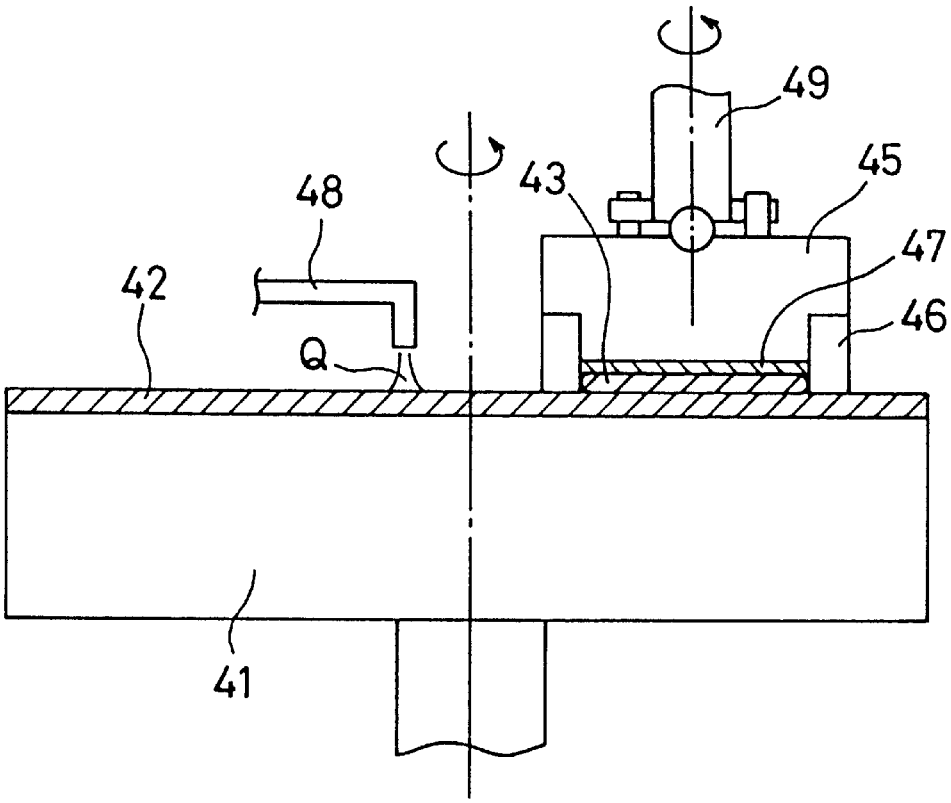
FIG. 9 is a vertical cross-sectional view of a conventional polishing apparatus.
Figure 10:
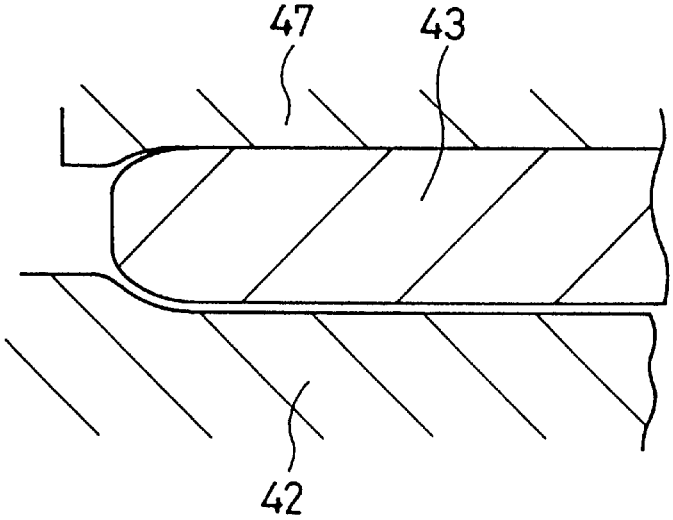
FIG. 10 is an enlarged fragmentary vertical cross-sectional view of a semiconductor wafer, an abrasive cloth, and an elastic pad of the conventional polishing apparatus.
Figure 11:
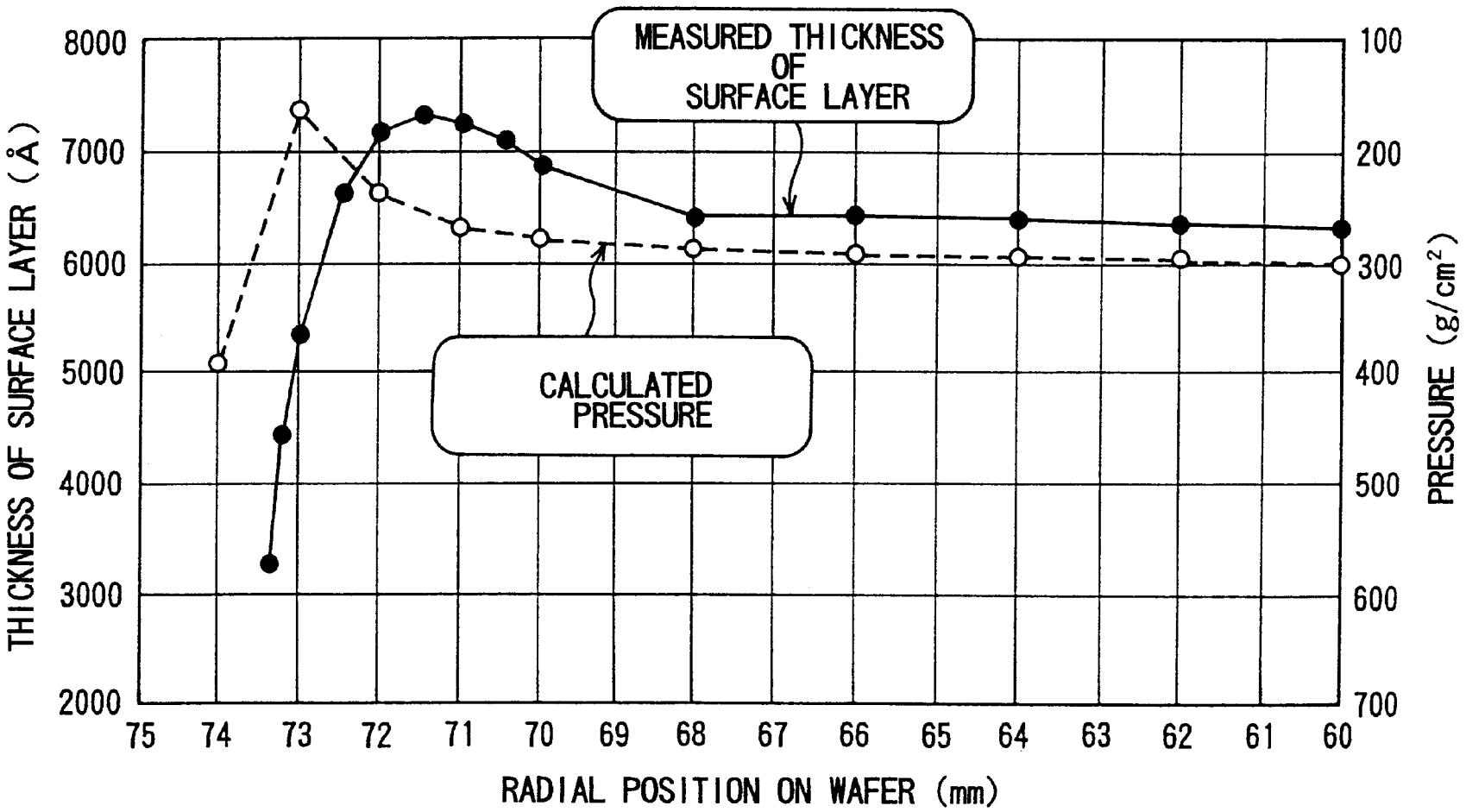
FIG. 11 is a graph showing the relationship between radial positions and polishing pressures, and the relationship between radial positions thicknesses of a surface layer of a semiconductor wafer.

FIGS. 8A through 8D show an example in which the amount of a material removed from a peripheral portion of a workpiece is smaller than the amount of a material removed from an inner region of the workpiece. As shown in FIGS. 8A through 8D, a semiconductor device as a workpiece to be polished comprises a substrate 36 of silicon, an oxide layer 37 deposited on the substrate 36, a metal layer 38 deposited on the oxide layer 37, and an oxide layer 39 deposited on the metal layer 38. FIG. 8A illustrates the semiconductor device before it is polished, and FIG. 8B illustrates the semiconductor device after it is polished. After the semiconductor device is polished, the metal layer 38 is exposed at the peripheral edge thereof. When the polished semiconductor device is washed with a chemical, the exposed metal layer 38 is eroded by the chemical as shown in FIG. 8C. In order to prevent the exposed metal layer 38 from being eroded by the chemical, it is preferable to polish the semiconductor device such that the amount of a material removed from the peripheral portion of the semiconductor device will be smaller than the amount of a material removed from the inner region of the semiconductor device, thereby leaving the oxide layer 39 as a thick layer on the peripheral portion of the semiconductor device. The principles of the present invention are suitable for polishing the semiconductor device to leave the oxide layer 39 as a thick layer on the peripheral portion of the semiconductor device.

While the workpiece to be polished according to the present invention has been illustrated as a semiconductor wafer, it may be a glass product, a liquid crystal panel, a ceramic product, etc. The top ring and the guide ring may be pressed by hydraulic cylinders rather than the illustrated air cylinders. The guide ring may be pressed by electric devices such as piezoelectric or electromagnetic devices rather than the illustrated purely mechanical devices.

Although certain preferred embodiments of the present invention have been shown and described in detail, it should be understood that various changes and modifications may be made therein without departing from the scope of the appended claims.

What is claimed is:

1. An apparatus for polishing a workpiece, said apparatus comprising:

a turntable having mounted on an upper surface thereof an abrasive cloth;

a top ring for holding a workpiece and pressing the workpiece against said abrasive cloth under a first pressing force to thereby polish the workpiece;

a guide ring for retaining the workpiece under said top ring, said guide ring being positioned around said top ring and being vertically movable; and a pressing device for pressing said guide ring against said abrasive cloth under a second pressing force that is variable and that is created by a nonrotatable pressure chamber that is fixed to a stationary member and to which a pressurized fluid is supplied.

2. An apparatus as claimed in claim 1, wherein said first pressing force and said second pressing force are variable independently of each other.

3. An apparatus as claimed in claim 1, wherein said second pressing force is determined based on said first pressing force.

4. An apparatus as claimed in claim 3, wherein said second pressing force is substantially equal to said first pressing force, thereby to provide that during polishing a thickness of material removed from a peripheral portion of the workpiece will be the same as a thickness of material removed from an inner region of the workpiece.

5. An apparatus as claimed in claim 3, wherein said second pressing force is less than said first pressing force, thereby to provide that during polishing a thickness of material removed from a peripheral portion of the workpiece will be greater than a thickness of material removed from and inner region of the workpiece.

6. An apparatus as claimed in claim 3, wherein said second pressing force is greater than said first pressing force, thereby to provide that during polishing a thickness of material removed from a peripheral portion of the workpiece will be less than a thickness of material removed from and inner region of the workpiece.

7. An apparatus as claimed in claim 3, wherein said pressing device comprises a fluid pressure cylinder defining said nonrotatable pressure chamber.

8. An apparatus as claimed in claim 7, wherein said stationary member comprises a top ring head supporting said top ring, and said fluid pressure cylinder is fixed to said top ring head.

9. An apparatus for polishing a workpiece, said apparatus comprising:

a turntable having mounted on an upper surface thereof an abrasive cloth;

a top ring for holding a workpiece and pressing the workpiece against said abrasive cloth under a first pressing force to thereby polish the workpiece;

a guide ring for retaining the workpiece under said top ring, said guide ring being rotatable with said top ring;

a bearing holder positioned around said guide ring and fixed to a stationary member; and a bearing housed in said bearing holder between said bearing holder and said guide ring so that said guide ring is rotatable relative to said bearing holder.

10. An apparatus as claimed in claim 9, further comprising a pressing device fixing said bearing holder to said stationary member and operable to press said bearing holder and thereby said guide ring toward said abrasive cloth.

11. An apparatus for polishing a workpiece, said apparatus comprising:

a turntable having mounted on an upper surface thereof an abrasive cloth;

a top ring for holding a workpiece and pressing the workpiece against said abrasive cloth under a first pressing force created by a first fluid pressure cylinder fixed to a top ring head, to thereby polish the workpiece;

a guide ring for retaining the workpiece under said top ring, said guide ring being positioned around said top ring and being vertically movable; and a pressing device for pressing said guide ring against said abrasive cloth under a variable second pressing force that is created by a second fluid pressure cylinder that is fixed to said top ring.

12. An apparatus as claimed in claim 11, wherein said top ring, said guide ring and said second fluid pressure cylinder are rotatable together.

* * * * *